US009963397B2

(12) United States Patent
Escarabajal et al.

(10) Patent No.: US 9,963,397 B2
(45) Date of Patent: May 8, 2018

(54) METHOD AND DEVICE FOR RECOVERING, FROM SUSPENSIONS CONTAINING EXPLOSIVE CHARGES, SAID EXPLOSIVE CHARGES, DRY

(71) Applicant: EURENCO, Massy (FR)

(72) Inventors: Franck Escarabajal, Monteux (FR); Mathieu Fontes, Le Pontet (FR); Sébastien Gavelle, Sorgues (FR)

(73) Assignee: EURENCO, Massy (FR)

( * ) Notice: Subject to any disclaimer, the term of this patent is extended or adjusted under 35 U.S.C. 154(b) by 0 days. days.

(21) Appl. No.: 15/129,962

(22) PCT Filed: Mar. 27, 2015

(86) PCT No.: PCT/FR2015/050790

§ 371 (c)(1),
(2) Date: Sep. 28, 2016

(87) PCT Pub. No.: WO2015/145088

PCT Pub. Date: Oct. 1, 2015

(65) Prior Publication Data

US 2017/0137336 A1 May 18, 2017

(30) Foreign Application Priority Data

Mar. 28, 2014 (FR) ..... 14 00760

(51) Int. Cl.
*D03D 43/00* (2006.01)
*C06B 25/34* (2006.01)
(Continued)

(52) U.S. Cl.
CPC ..... *C06B 25/34* (2013.01); *C06B 21/0033* (2013.01); *C06B 21/0091* (2013.01)

(58) Field of Classification Search
USPC ..... 149/109.6
See application file for complete search history.

(56) References Cited

U.S. PATENT DOCUMENTS 3,093,523 A * 6/1963 Besser ..... C06B 21/0008 149/100
5,637,216 A * 6/1997 Dillier ..... B01D 29/012 210/335

FOREIGN PATENT DOCUMENTS

DE 402505 C 9/1924
DE 1143790 B 2/1963
(Continued)

OTHER PUBLICATIONS

Jun. 10, 2016 International Search Report issued in International Patent Application No. PCT/FR2015/050790.
(Continued)

*Primary Examiner* — James E McDonough
(74) *Attorney, Agent, or Firm* — Oliff PLC

(57) ABSTRACT

A method for obtaining the explosive charge in dry granular form as well as a device suitable for implementing the method. The method includes: filtering the suspension, by passing same through a static filter in order to obtain a cake containing the granular explosive charge agglomerated by residual liquid; dewatering the cake by subjecting the cake to pressurized gas; splitting the dewatered cake and obtaining a fluidized bed of the desired explosive charge by exposing the dewatered cake to at least one stream of gas; at least one stream of gas being injected, under the dewatered cake to impinge said dewatered cake, according to two consecutive modes and the gas having a humidity height below that of the dewatered cake and a dew point temperature higher than the injection temperature thereof; and stopping at least one stream of gas and recovering the explosive charge in dry, granular form.

19 Claims, 8 Drawing Sheets

(51) Int. Cl.
*C06B 21/00* (2006.01)
*D03D 23/00* (2006.01)

(56) References Cited

FOREIGN PATENT DOCUMENTS

| | | | |
|---|---|---|---|
| DE | 3338572 | A1 | 5/1985 |
| DE | 3829936 | A1 | 3/1990 |
| EP | 0002847 | A1 | 7/1979 |
| EP | 0302448 | A2 | 2/1989 |
| WO | 93/06908 | A1 | 4/1993 |

OTHER PUBLICATIONS

Jun. 10, 2016 Written Opinion issued in International Patent Application No. PCT/FR2015/050790.

* cited by examiner

METHOD AND DEVICE FOR RECOVERING, FROM SUSPENSIONS CONTAINING EXPLOSIVE CHARGES, SAID EXPLOSIVE CHARGES, DRY

The present invention comes within the field of granular explosives (binder-free pulverulent explosives) having civil or military usages.

A subject matter of the present invention is a process for the recovery, from a suspension comprising an explosive charge (noncontinuous or dispersed phase) in a liquid (continuous phase), of said explosive charge in dry and granular form. Such suspensions are generally obtained on conclusion of processes of crystallization of molecules in solution (molecules synthesized upstream). Another subject matter of the invention is a device suitable for the implementation of said process.

The process concerned, which is novel, is economical in time and also in consumable fluids and it limits the pyrotechnical risks.

According to the process of the prior art employed to date by the Applicant, the suspension concerned is filtered through a static filter. A cake, consisting of the explosive charge concerned (retained on said filter), having a high content of liquid (of moisture, where the suspension concerned is an aqueous suspension), is recovered. Said cake is subsequently spread (manually, as a thin layer, with appropriate implements) over trays. The trays charged with this spread cake are placed in an oven (under hot conditions) for 1 to 2 days. Finally, the dry explosive charge (including less than 0.1% (by weight) of liquid (of moisture (see above)) is recovered on said trays. In addition to the handling of the explosive by the operator, which constitutes a risk, this process exhibits the disadvantage of consuming energy (very particularly in the stoving phase) and of requiring operating times of several tens of hours.

There exist commercial filtration and drying devices, such as the Pressofiltro® sold by Heinkel (DE), which make it possible, within one and the same device, to carry out a filtration operation (on a suspension), in order to obtain a cake, then a mechanical scraping of said cake, in order to fragment it, accompanied by drying by an air stream, in order to make possible the recovery, at the end, of grains (of powder) having a very low moisture content. However, such devices, mainly used in the food-processing industry, are not appropriate, in the context of the invention, as the operation of scraping the cake is liable to detonate the explosive charge, due to the sensitivity to frictional actions and to static electricity of the latter.

The patent application DE 33 38 572 describes a process and a device for the recovery of dry materials from suspensions (including said materials). Within one and the same device including a filter, the suspensions are filtered and then the cakes obtained on said filter are, after an optional washing operation, broken up and transformed into a fluidized bed of dry materials. Hot gases are employed for these breaking up and drying purposes. They are injected, under unvarying conditions, at a high flow rate (3 $m^3/s$ (=10 800 $m^3/h$) is mentioned in the example) into a distribution chamber located under said filter. The action of said hot gases (through the filter, from said distribution chamber), optionally combined with the mechanical action of a paddle stirrer, converts said cakes into fluidized beds of the desired dry materials.

The device described comprises a cylindrical enclosure, into the bottom part of which a filter is fitted, on a support screen. The suspension is introduced via a nozzle arranged in the top part of the enclosure. The cake generated on the filter can be washed by injection of a washing liquid via said nozzle. A chamber is arranged in the bottom part of the enclosure, under the filter, into which chamber emerges a nozzle for delivering the drying gases. Said nozzle, in the light of the high gas flow rates to be delivered, exhibits a high diameter. It is equipped with a cap which protects it from the liquid phase of the suspension (during the filtration phase) and from the possible washing liquid (during the optional phase of washing the cake). This cap furthermore ensures the distribution, in said chamber, of the injected drying gases and thus the pressurization of said chamber. It is from this pressurized chamber that the drying gases will act on the cake, the injected gases thus not impacting the cake on exiting from their injection nozzle. The drying gases, delivered at a high unvarying flow rate, thus ensure, at first, the pressurization of the chamber and, subsequently only, the "eruptive" breaking up of the cake for the creation of the fluidized bed. Such a breaking up implies per se major and random mechanical stresses. It may be promoted by the action of the paddle stirrer. In such a context, even without mechanical stirring and a fortiori with, the cake breaks up suddenly and uncontrollably. The process and the device according to the patent application DE 33 38 572 are those most certainly not suitable for the recovery of explosive charges from suspensions in which they are present. They are most certainly described for the recovery of dry inert (pyrotechnically insensitive) charges, such as food-processing charges. In support of this assertion, it may be noted that said process and said device are described for treating (without danger) high weights (weight at 1200 kg of crystals, generating a cake with a respective thickness and a respective diameter of 0.5 m and 1.6 m in the example) within a device with the appropriate dimensions.

A person skilled in the art is thus looking for an effective process which makes it possible, without danger, to recover, from a suspension of an explosive charge in a liquid, said explosive charge in dry and granular form. He is more specifically looking for a process which makes it possible to dry the cake, obtained by filtration of a suspension of an explosive charge, in order to recover said explosive charge in the granular (pulverulent) and dry form, which process does not require several handling steps, is economical in energy and in time and does not involve mechanical stresses on said explosive charge.

Reference is made above and below to granular or pulverulent explosives. The term "powder" might be used but it is not used in this context of explosive materials in order to avoid any confusion with propellant powders for tube weapons.

A main subject matter of the present invention is thus a process for obtaining, from a suspension of an explosive charge in a liquid, said explosive charge in dry and granular form. Said process comprises:

a) filtering, by passage through a static filter, said suspension, in order to obtain a cake, (resting) on said filter, including said explosive charge agglomerated by residual liquid;

b) dewatering said cake by placing it under gas pressure;

c) disintegrating the dewatered cake and obtaining a fluidized bed of the desired explosive charge, in dry and granular form, by the action, on said dewatered cake, of at least one gas jet, said at least one gas jet being injected, under said dewatered cake, in order to impact said dewatered cake, according to two successive sets of conditions:

at first, at pressure p and at flow rate f, in order to create, in the dewatered cake, channels emerging in the upper part of said dewatered cake and also a fluidized bed above said dewatered cake; then subsequently, at pressure p and at flow rate F, F>f, in order to put the dewatered cake, traversed by said channels, under lift and to complete its disintegration;

and said gas exhibiting a lower moisture content than that of the dewatered cake and a dew point greater than its injection temperature; and d) stopping said at least one gas jet and recovering the explosive charge in dry and granular form.

The process of the invention thus proposes to get rid of the liquid present in the filtration cake (residual liquid which has not been removed in the filtration) by subjecting said cake, as generated on the filter (on conclusion of step a), to, successively, a dewatering step (step b) and a disintegration/drying step (step c). Said disintegration/drying step (step c) is based on a two-fold action of at least one gas jet (controlled mechanical action for disintegrating the dewatered cake, in two steps, by impact of the at least one jet on the cake (=direct impact)) in order to generate a fluidized bed, in conjunction with a thermal drying action).

It is intended, below, to provide details, in no way limiting, on the process of the invention and each of its various steps.

It may already be indicated that the process of the invention makes it possible to obtain explosive charges in granular (pulverulent) form and containing, by weight, less than 1% of liquid, advantageously less than 0.1% of liquid.

The suspensions, treated according to the process of the invention, can be of the type of those treated to date according to the process of the prior art summarized in the introduction of the present text (i.e. generally suspensions of crystals in a non-solvent (capable of including a low content of solvent) obtained on conclusion of the implementation of a crystallization step). This is because the process of the invention is very particularly (but not in a limitative way) suitable for treating the suspensions conventionally obtained and treated, to date, according to the technique of the prior art, involving handling operations and stoving, which is summarized above. The results obtained, under much more advantageous conditions (see below), are similar to, indeed even better than, those obtained with said technique of the prior art.

Incidentally, it should be noted here that the process of the invention is not, however, limited to the treatment of suspensions of crystals. The solid (dispersed) phase of the suspensions concerned may consist of crystals and of grains, may not include crystals and solely grains. On reading the description below, in detail, of the process of the invention, it is understood that the form of the solid phase (dispersed phase) of the suspensions concerned is not determining. However, it is understood that the constituent particles of said solid phase have to be a reasonable size ($D_{50}$ generally less than 1 mm, very generally less than 500 μm).

The process of the invention is generally carried out with suspensions for which the liquid/explosive charge ratio by weight is between 5 and 20 (extreme values included).

The critical detonation height of the explosive charge concerned sets the acceptable maximum cake thickness for safe use of the process of the invention. Thus, the use of the process of the invention is generally designed to recover from 5 to 15 kg of dry explosive charge (this being the case within a device exhibiting "reasonable" dimensions).

a) The filtration step of the process of the invention is not novel per se. It is a filtration on a static filter. The porosity of the filter is obviously appropriate for the particle sized distribution (granulometry) of the suspended charge. It is advisable to stop (virtually) all of said suspended charge. The constituent components of the suspended charge generally exhibit a median diameter with a value of between 50 and 400 μm. The pores of the filter for their part have a diameter which is obviously less than said median diameter, generally of between 30 and 200 μm. With reference to the implementation of step c of the process of the invention (disintegration and drying step) comprising the action of at least one gas jet through the filter, the filter must not bring about an excessively sizable pressure drop: its openness should thus be high.

The static filter concerned is generally a metal filter, for example a filter made of stainless steel. It is a priori positioned horizontally but it is entirely possible to provide a slight slope targeted at facilitating the recovery of the dry charge at the end of the process.

On conclusion of the filtration, a cake including the explosive charge agglomerated by residual liquid is found on the filter. This residual liquid corresponds to the complement of the liquid which is passed through the filter, the liquid of the starting suspension corresponding to said liquid which is passed through the filter and to said residual liquid.

The cake resting on the filter, on conclusion of the filtration, generally exhibits a liquid/explosive charge ratio by weight of between 1 and 8 (extreme values included). Such a ratio by weight, obtained on conclusion of a conventional filtration, will not surprise a person skilled in the art.

The cake resting on the filter, on conclusion of the filtration, generally has a height (thickness) of 5 to 20 cm. The process of the invention a priori is scarcely of advantage if it is employed for the recovery of a very low amount of charge (cake with a height of less than 5 cm) and a person skilled in the art understands that the management of the following steps of the process (steps b and c of said process), during which the explosive charge has a reduced moisture content, may prove to be problematic, with reference to the critical detonation height of the charge concerned, with cakes which are very thick (thickness obviously related to that of the cakes obtained on conclusion of filtration (hence the limitation of thickness, generally of a maximum of 20 cm, of said cakes obtainable on conclusion of filtration)).

b) In the context of the implementation of the process of the invention, the cake obtained on the filter remains on the filter and it is there, at first, dewatered. It is dewatered by placing it under gas pressure (pressure generated upstream thereof).

The dewatering carried out by placing under gas pressure (dewatering which brings about a decrease in the height of the cake) is advantageously carried out with gases under a pressure between $2\times10^5$ and $3\times10^5$ Pa absolute (2 and 3 bar absolute) (extreme values included).

The gas used for the implementation of the dewatering of the cake is obviously a gas which is inert with respect to the explosive charge. It can in particular consist of air, nitrogen or helium. It advantageously consists of air.

On conclusion of the dewatering (the duration of such a dewatering generally being from 30 min to 1 h), the dewatered cake generally exhibits a liquid/explosive charge ratio by weight between 0.5 and 2 (extreme values included).

As regards the height of said dewatered cake (thus including a reduced moisture content) resting on the filter, it is logically limited with reference to the critical detonation height of the charge concerned (see above). It is generally a maximum of 10 cm.

c) In the context of the implementation of the process of the invention, the dewatered cake (on conclusion of the dewatering), still positioned on the filter, is disintegrated (eroded) mechanically until the explosive charge is obtained in dry and granular form as a fluidized bed. In order to ensure the two-fold action already specified above, a two-fold mechanical (controlled, in two steps, by direct impact of the at least one gas jet) and thermal (drying) action, gas is thus injected in the form of at least one jet according to two successive sets of conditions, said at least one jet (directly) impacting the face of the dewatered cake resting on the filter.

The gas injected during this step c of the process is obviously also a gas which is inert with respect to the explosive charge. It can also in particular consist of air, nitrogen or helium. It also advantageously consists of air. The same gas is advantageously used for the implementation of steps b (dewatering of the cake) and c (disintegrating the cake and obtaining the fluidized bed) of the process of the invention.

More particularly with reference to the mechanical action of the injected gas, that which follows is expanded on. The at least one jet (directly) impacts the dewatered cake positioned on the filter in order to generate, in two steps, the fluidized bed (very obviously above said filter). To this end, the gas is injected below said cake (thus below said filter) (directly) in contact with said cake, according to two successive sets of conditions.

The management of the number of jets (it is generally advantageous to inject the gas for disintegrating and drying the dewatered cake in the form of at least two jets), of the exact position, of the orientation and of the power of said jet(s), for the purpose of obtaining the expected result, is within the scope of a person skilled in the art. The expected result is advantageously obtained in 45 min to 2 h. This period of time obviously depends on the moisture content and of the bulk density of the explosive charge which are desired at the end of the process (density given by the size of the grains, which depends on the degree of disintegration of the cake).

In the context of the implementation of this step c of the process of the invention, the gas is thus injected under the dewatered cake (under the filter), in order to impact the lower face of said dewatered cake, according to two successive sets of conditions:

firstly, at pressure p and at flow rate f, in order to create, in the dewatered cake, channels emerging in the upper part of said dewatered cake and also a fluidized bed above said cake; then, secondly, at pressure p and at flow rate F (F>f), in order to place the dewatered cake, traversed by said channels, under lift (said cake then being disintegrated at its surface and in its volume (in its traversing channels)) and to complete its disintegration.

In a way which is not in the least limiting, it is possible to indicate: $5 \leq p \leq 7$ bar, $20 \geq f \geq 50$ $Nm^3/h$ and $100 \geq F \geq 200$ $Nm^3/h$ for a suspension including 10 kg of explosive charge in a liquid/charge ratio by weight of 7.5 (see the example below). The gas flow rates can be increased or reduced, with respect to these indicative values, as a function in particular of the weight of the charge to be dried.

The mechanical actions of the at least one gas jet during these two phases of implementation of step c of the process of the invention are specified below somewhat:

c1) the injection of said gas jet(s), through the pores of the filter, under the dewatered cake, thus creates, by mechanical erosion (first type of erosion which may be described as "direct erosion" of the jet(s)), channels in the thickness of said dewatered cake, which finish by merging at the upper face of said dewatered cake, then acting as chimneys; the components (grains) extracted by mechanical erosion of the dewatered cake during disintegration, at the outlet of said chimneys, constitute a fluidized bed above said cake and themselves contribute, by their movements and impacts, to the erosion (second type of erosion, which may be described as "indirect erosion") of the top part of said cake and thus to the entrainment of new components (grains) into the fluidized bed, thus in expansion; then, c2) the increase in the flow rate of said gas jet(s) brings the cake (partially disintegrated) under lift and ensures the continuation of its erosion (disintegration), over all its surface and in its volume, by the components (grains) in a fluidized bed (continuation of the "indirect erosion").

It is very obviously understood that the channels are created in the impact surface of said jet(s) facing the pores of the filter.

The pressures and flow rates put forward above are not necessarily unvarying. It is even recommended to carry out the first and second phases of injection of gas at pressures p and flow rates f and F which are not unvarying and which are increasing. It has been understood that, in any case, the jet(s) of the second set of conditions is (are) more powerful than the jet(s) of the first set of conditions.

In parallel with this mechanical action (controlled, in two steps, by direct impact), the jet(s) develop(s) a drying action. This drying action increases in effectiveness as the disintegration of the cake progresses (as it is carried out on components which are increasingly small) and as the gas injected per se exerts a stronger drying action (see below).

More particularly with reference to the thermal (drying) action, that which follows may be indicated. The injected gas exhibits suitable moisture contents and suitable temperatures. This is because it has been understood that said injected gas constitutes the means for removing the liquid remaining in the dewatered cake. In order for it to perform this role, said injected gas has to exhibit a lower moisture content than that of said dewatered cake. Generally, this moisture content of the injected gas is much lower than that of said dewatered cake: specifically, it is generally less than 2% (by weight). As regards the temperature of the injected gas, it has to be greater than its dew point. It is generally between 20 and 70° C., advantageously between 50 and 70° C. A higher temperature provides the drying in a shorter period of time. However, it is very clearly advisable for the temperature of the injected gas (of the (disintegrating and) drying gas) to be compatible with the stability of the charge present. The drying gas is thus injected dry (i.e. at a moisture content lower than that of the dewatered cake) at a temperature which provides effective drying in a reasonable period of time.

During step c, the gas jet(s) thus develop(s) a two-fold action, a mechanical (disintegration (erosion), in two steps, controlled) and thermal (drying) action. They (It) impact(s) the dewatered cake in order to put the explosive charge into a fluidized bed and dry (dries) the disintegrating and finally completely disintegrated components of said cake (they (it) then dry (dries) the components of the fluidized bed). They (it) entrain(s) virtually all of the liquid remaining in the dewatered cake (on conclusion of step b), in order to obtain the dry granular explosive charge as a fluidized bed. The entrained liquid (in the gaseous form and optionally in the form of droplets) is discharged with the injected gas (advantageously air).

d) The injection of the gas jet(s) being stopped, the grains of the fluidized bed settle, by gravity, on the filter. They are recovered there, dry. They can in particular be recovered there, including less than 1% and even less than 0.1% of liquid (see above).

Advantageously, the liquid recovered during implementation of (filtration) step a and/or very advantageously of (dewatering) step b of the process of the invention is recovered for recycling (for the preparation of new suspensions upstream).

It is highly recommended, with reference to safety, to carry out at least steps c and d of the process, involving the presence of a dry explosive charge, indeed even all the steps of said process, while providing for the discharge of the electric charges liable to accumulate. Continual monitoring of this discharge (i.e. of the electrical continuity of the device, used for the implementation of said process, with the earth) is appropriately carried out during at least said steps c and d of said process, indeed even throughout the implementation of the process.

The process of the invention is suitable for treating many types of explosive charge suspensions. However, a person skilled in the art already understands that its implementation is a priori more problematic for treating suspensions including explosive charges particularly sensitive to static electricity, such as hexanitrohexaazaisowurtzitane (HNIW or CL20).

In any case, a person skilled in the art is in a position to manage the parameters of the process (with or without earthing the device, advantageously with, within which it is carried out) as a function of the weight of charge concerned and of the sensitivity of the charge concerned.

The explosive charge of the suspensions treated according to the invention can in particular be chosen from 3-nitro-1,2,4-triazol-5-one (ONTA), ammonium dinitramide (ADN), 2,4,6-triamino-1,3,5-trinitrobenzene (TATB) and trinitrotoluene (TNT) charges. The implementation of the process of the invention is very particularly recommended with the suspensions described in patent applications WO 2010/31962 (ADN suspensions) and WO 2006/108991 (ADN suspensions) and in U.S. Pat. No. 4,894,462 (ONTA suspensions).

It should be noted that it is not completely ruled out for the explosive charge of the suspensions treated according to the invention to comprise a mixture (of charges) of explosives of different natures.

The nature of the liquid constituting the continuous phase of the suspension of course depends on the nature of the charge and of the process carried out upstream in order to obtain the suspension (a process which is generally concluded with a crystallization). Said liquid can in particular be chosen from water, acidic aqueous solutions and organic solvents, in particular aliphatic hydrocarbons (such as alkanes (for example: hexane, heptane, octane)), halogenated aliphatic hydrocarbons (such as chlorinated aliphatic hydrocarbons (for example: 1,2-dichloroethane)), aromatic hydrocarbons (for example: toluene and xylenes) and non-flammable hydrofluoroethers (for example: 2-trifluoromethyl-3-ethoxydodecafluorohexane).

A person skilled in the art has already understood all the advantages of the process of the invention.

The process of the invention is perfectly suited to explosive charges insofar as it does not involve much mechanical stress, in fact involves weak controlled mechanical stresses (see the direct impact of the at least one jet on the cake, according to two successive sets of conditions, which is responsible for a gradual disintegration (as specified above)).

The process of the invention advantageously substitutes for the process made use of to date by the Applicant (see the introduction of the present text). This is because:

it works within a single device (which prevents any transfer, any handling, of the explosive charge (during its drying));

it involves only weak controlled mechanical stresses of the explosive charge and thus it works with a limited explosive risk;

its implementation requires a low energy consumption, hardly any consumables (such as boxes, bags, implements, and the like), it is completely reproducible (see the above description of the various steps of the process) and makes it possible to obtain advantageous results in periods of time which are much less than those required by the process made use of to date;

its operating costs and the industrial areas required are also lower than those of said process made use of to date;

the final product obtained is furthermore of high quality.

According to its second subject, the invention relates to a device (very particularly) suitable for the implementation of the process of the invention.

Such a device comprises:

a substantially cylindrical enclosure equipped, in its volume, in its bottom part, with a filter suitable for the filtration of a suspension and thus for the retention of the solid (dispersed) phase of said suspension (in the form of a cake);

means for feeding said enclosure with a suspension, which means are arranged above said filter, and means for discharging liquid from said enclosure, which means are arranged below said filter;

means for pressurizing said enclosure, which means are arranged above said filter, said pressurizing means advantageously being equipped with deflection means;

gas-injection means, which means are arranged below said filter and are suitable for delivering said gas in the form of at least one upward jet intended to impact the face of said retained solid phase resting on said filter;

means for the discharge of gas from said enclosure, which means are arranged above said filter, said discharge means advantageously being equipped with a particle filter; and it is advantageously, in its entirety, electrically connected to earth.

Such a connection is obviously appropriate with reference to safety. Its presence or absence is to be assessed by a person skilled in the art (see above). In order to complete the safety arrangements, the device can additionally comprise means for continuously monitoring its electrical continuity with the earth.

A preferred alternative form of said device is described below with reference to the appended figures. The means set out above are specified in this description.

It has been seen above that the filter concerned is advantageously a metal filter, in particular a filter made of stainless steel (generally arranged horizontally).

The means for injection of gas onto the solid phase retained on said filter (=cake) are arranged below said filter (directed towards the lower face of the cake). Said means for injection of gas are suitable for delivering said gas in the form of upward jets, said jets (directly) impacting the face of the cake resting on the filter (this (direct) impact excludes cap and chamber for distributing the drying gases, as provided in the device according to the application DE 33 38 572). Said injection means are obviously suitable for injections according to the two successive sets of conditions provided.

The device of the invention comprises means for feeding it with the suspension to be treated. It more specifically comprises means for pouring said suspension over said filter. It is understood that said means comprise at least one (top) opening in the enclosure and that they provide such a pouring with a reasonable (advantageously minimal) drop height.

Appropriate means (generally at least one opening (equipped with at least one drain)), arranged in the bottom part of the enclosure, have to be provided in order to discharge, from the enclosure, the liquid which passes through the filter, during the filtration and the dewatering. The same means are advantageously used, for the discharge of liquid, during said filtration and said dewatering.

According to the invention, the device comprises means for pressurizing the enclosure (for the purposes of dewatering the solid phase retained on the filter). Said means (including compressor+pipeline+opening of the enclosure) make it possible to feed the upper part of the enclosure (above the filter) with a pressurized gas. In order to reduce the direct impact of this feeding on the cake, provision is advantageously made to combine said pressurizing means with deflection means (deflectors).

The device also comprises, in its top part, means for discharging gas (mainly injected gas but also gaseous residual liquid and possibly residual liquid in the form of droplets), said means advantageously comprising a particle filter (a filter cartridge capable of trapping the smallest grains, extracted from the dewatered cake, entrained by the gas stream).

It should be remembered that the injection of (hot) gas via the injection means (injection bringing about a (direct) impact on the cake) makes it possible to erode (to disintegrate) the dewatered cake and to put the charge into a fluidized bed, while drying said charge and while entraining the residual liquid in the (hot) gas stream toward the means for discharge of the gas, advantageously equipped with the particle filter. Said injection means are suitable for injecting the gas in the form of a single jet or in the form of several jets, advantageously in the form of at least two jets.

It is now intended to illustrate the invention, in a way not in the least limiting, under its process and device aspects, by the appended figures and the example below.

FIGURES

FIGS. 1A to 4 diagrammatically show a device of the invention at different steps of the process of the invention.

Figure 1A:
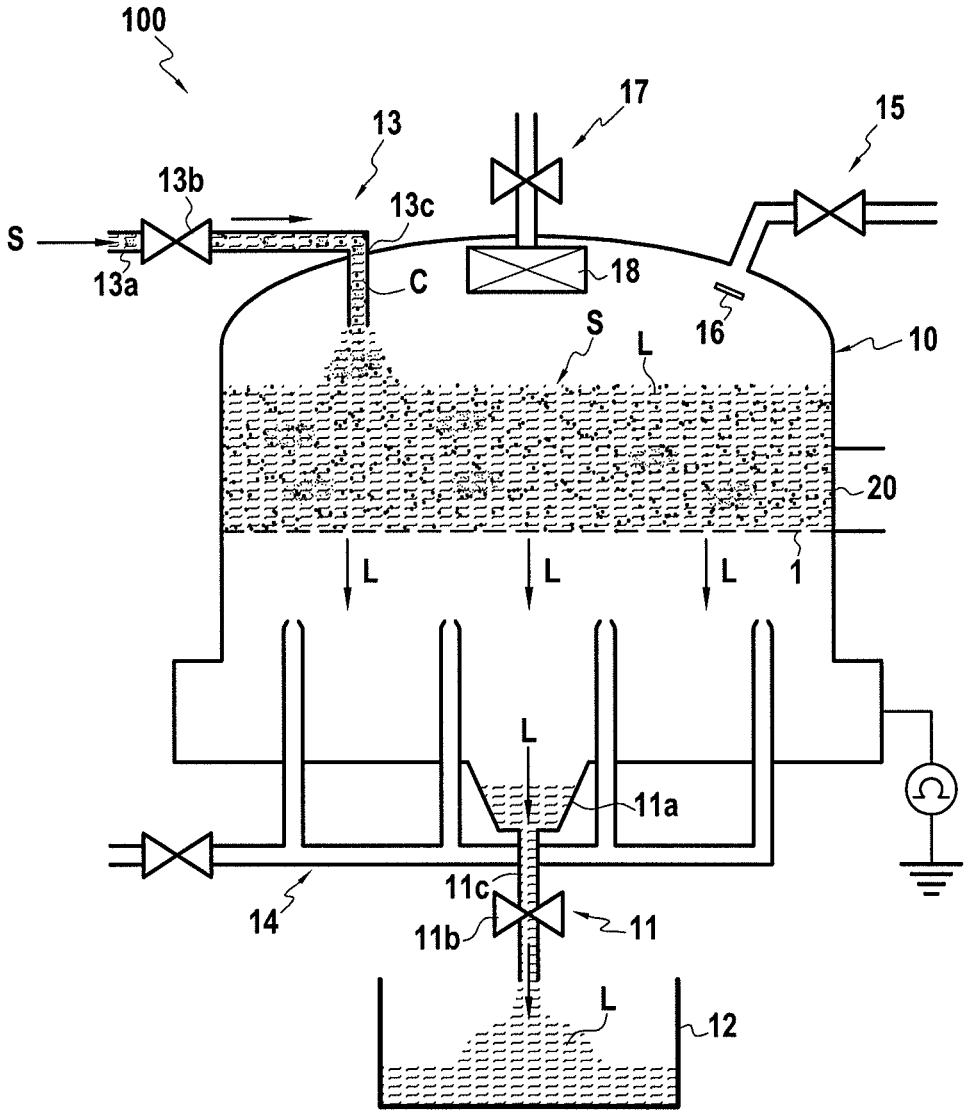
FIGS. 1A and 1B illustrate the filtration step (respectively at the start and end of said filtration).

The intention is first of all to describe the device of the invention represented in said figures (represented in the course of operation).

The constituent components of said device are described, more specifically with reference to the figures diagrammatically representing process phases during which they are or were directly involved.

In each of the figures, a device 100 comprising an enclosure 10 of substantially cylindrical shape has been shown. In the volume of said enclosure 10, in the bottom part of the volume, the filter 1 is found. Said device 100 additionally comprises:

means 13 for feeding said enclosure 10 with the suspension S to be filtered. These means are arranged in the top part of said enclosure 10, above said filter 1. These means 13 for feeding the suspension S are described more specifically below with reference to FIG. 1A. They comprise, according to the alternative form represented, a pipeline 13*a* for supplying said suspension S, a valve 13*b* for control of the supplying of said suspension S and an opening 13*c* arranged in the wall of said enclosure 10;

means 11 for discharge of the liquid L from said enclosure 10. Said means 11 are obviously arranged in the bottom part of said enclosure 10, under the filter 1. These discharge means are described more precisely below with reference to FIG. 1A. They comprise, according to the alternative form represented, an opening 11*a* arranged in the bottom of the enclosure 10, a drain 11*c* and a valve 11*b*. Said drain 11*b* is suitable for discharging the liquid L of the suspension S into a receptacle 12;

means 15 for pressurizing said enclosure 10. These means are obviously arranged above the filter 1. They are described more precisely below with reference to FIG. 2A. They are suitable for delivering the pressurizing gas G. They comprise upstream a supply of pressurized gas G or a compressor (means not represented) and then a pipeline 15*a* for supplying said pressurized gas G, a valve 15*b* for controlling the delivery of said pressurized gas G and an appropriate opening 15*c* made in the wall of the enclosure 10 (for the delivery, at the wall, of said pressurized gas G or the passage of said pipeline 15*a* providing the delivery of said gas G downstream of said opening 15*c* into the volume above the filter 1). A deflector 16 associated with said pressurizing means 15 has been shown in the figures. The intervention of such a deflector is appropriate for distributing the impact of the (dewatering) gas G over the maximum surface area of the cake 2 to be dewatered;

means 14 for injecting gas G' (it has been seen that advantageously G=G'), in order to direct jets 4 of said gas G' for action on the solid phase retained on said filter 1, for (direct) impact on (the lower face of) said solid phase. Said means 14 are, according to the alternative form represented, arranged (partially under said enclosure 10, completely under said filter 1) in order to deliver jets 4 of gas G' under said filter 1 (four vertical upward jets 4). These injection means 14 are described more precisely below with reference to FIG. 3A. They comprise a pipeline 14*a* for supplying said gas G', a valve 14*b* for control of the delivery of said gas G', branch pipelines 14*a*' oriented for delivery of jets 4 of gas G' through nozzles 14*d* (provided at their ends) and openings 14*c* made in the wall (the bottom) of the enclosure 10 for the passage of said branch pipelines 14*a*'. According to another alternative form, not represented, a pipeline equipped with a valve might correspond to each opening (14*c*);

means 17 for discharge of gas (of the gas G' and of the residual liquid L' in the gaseous state) from said enclosure 10. These means are obviously arranged above said filter 1, in the top part of the enclosure 10. They are advantageously positioned as shown in the figures, directly above the filter 1, at the maximum distance from the injection of said gas G'. Said means 17 are described more precisely below with reference to FIG. 3A. They comprise an orifice 17*c* made in the wall of the enclosure 10, a pipeline 17*a* for discharge of gas and a valve 17*b*. Said pipeline 17*a* emerges in the volume of the enclosure 10, according to the alternative form represented. A particle filter 18, capable of retaining the smallest particles generated by the disintegration of the dewatered cake 2', is associated with it. This filter might, according to another alternative form, be inserted in the wall, the pipeline not penetrating into the housing.

An opening of the enclosure 10 has been represented at 20, which opening makes possible the recovery of the dried charge, dry, at the end of the process.

It has also been shown, in each of the figures, that, according to the alternative form represented, the device 100 is electrically connected to earth, with continuous monitoring (Q) of the electrical continuity.

It is now intended to describe the process of the invention with reference to the appended figures.

As already indicated, FIG. 1A illustrates the start of the implementation of the filtration. The suspension S, including the explosive charge C in the liquid L, is delivered via the pipeline 13*a* of the feed means 13. The liquid L passes through the filter 1 and is recovered, via the means for discharge of liquid 11, in the receptacle 12. The valves 13*b* and 11*b* are obviously open and the valves 15*b* and 14*b* are for their part closed.

Figure 1B:
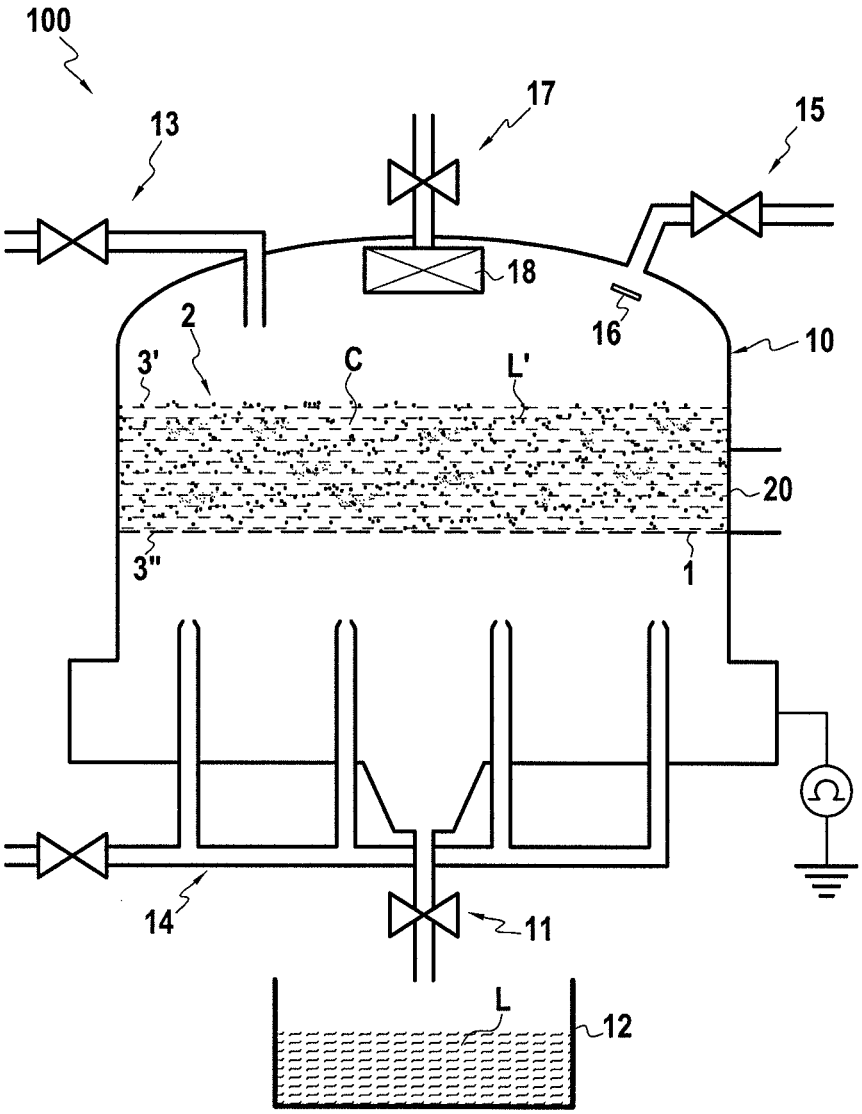

All the suspension S having been poured onto the filter 1, a filtration cake 2 is formed on said filter 1. This cake 2 matches the shape of the enclosure 10, over a portion of its height, by thus being placed on the filter 1. It is shown in FIG. 1B, illustrating the end of the filtration step. The liquid L of the suspension S retained in said cake is henceforth referenced L'. This cake 2 exhibits a thickness generally of between 5 and 20 cm (see above). Its upper surface has the reference 3' and its lower surface, resting on the filter 1, has the reference 3". On conclusion of this filtration step, the valve 13*b* is closed.

Figure 2A:
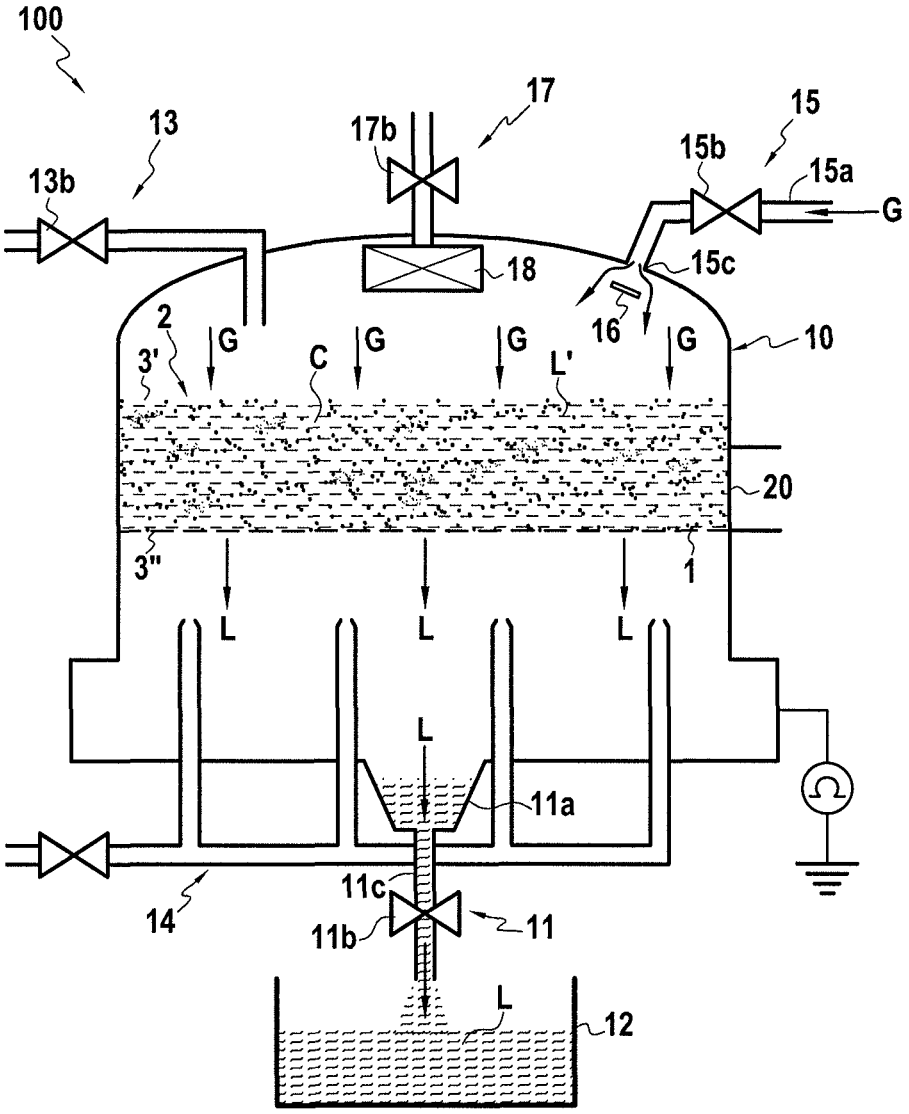
FIGS. 2A and 2B illustrate the step of dewatering the cake (respectively at the start and end of said dewatering).

Dewatering the cake 2 is represented diagrammatically in FIG. 2A. A portion of the liquid L' (liquid L trapped in the cake 2) is extracted from said cake 2 (and is recovered in the receptacle 12) under the action of the pressurizing gas G. The valves 13*b* and 17*b* being closed, the pressurizing gas G is delivered via the pressurizing means 15. It has been seen that the deflector 16 appropriately provides for the distribution of said gas G at the upper surface 3' of the cake 2. The same references 3' and 3" have been retained for, respectively, the upper and lower surfaces of the cake at the beginning of dewatering (FIG. 2A), during dewatering, at the end of dewatering (FIG. 2B) and in the first phase of disintegration (FIG. 3A).

Figure 2B:
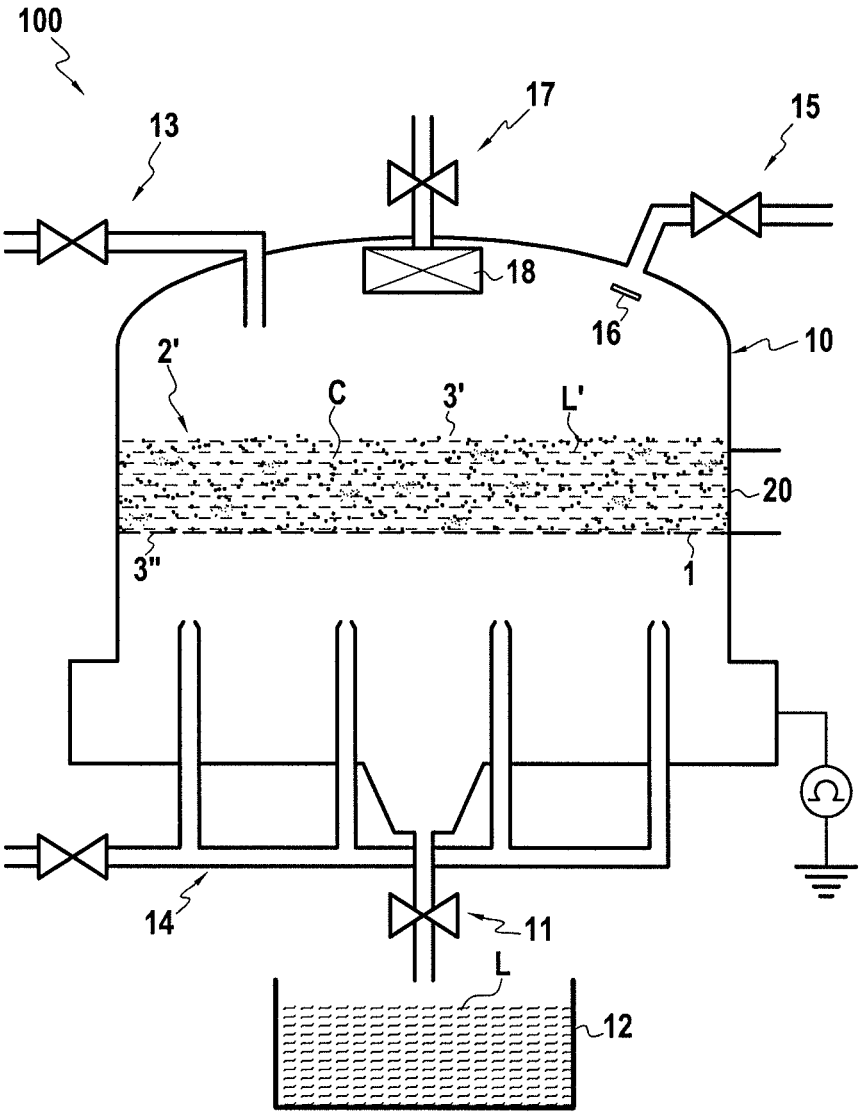

On conclusion of this step of dewatering the cake 2, feeding with the pressurizing gas G is stopped (the valve 15*b* is closed) and a dewatered cake 2' is thus found on the filter 1. This cake 2', with a thickness lower than that of the cake 2 (not dewatered), generally of less than 10 cm (see above), is represented in FIG. 2B.

The third step of the process of the invention (two-fold mechanical (in two steps) and thermal action of the gas G') is then carried out on said dewatered cake 2'. In the alternative form represented diagrammatically, the disintegration and drying gas G' is injected in the form of (four) jets 4 under the filter 1 (it thus (directly) impacts the dewatered cake 2' on its lower face 3" which rests on said filter 1) according to two successive sets of conditions (of pressure p and flowrates: f then F (see above)). The injection and its effect according to the first set of conditions have been represented diagrammatically in FIG. 3A and the injection and its effect according to the second set of conditions have been represented diagrammatically in FIG. 3B.

Figure 3A:
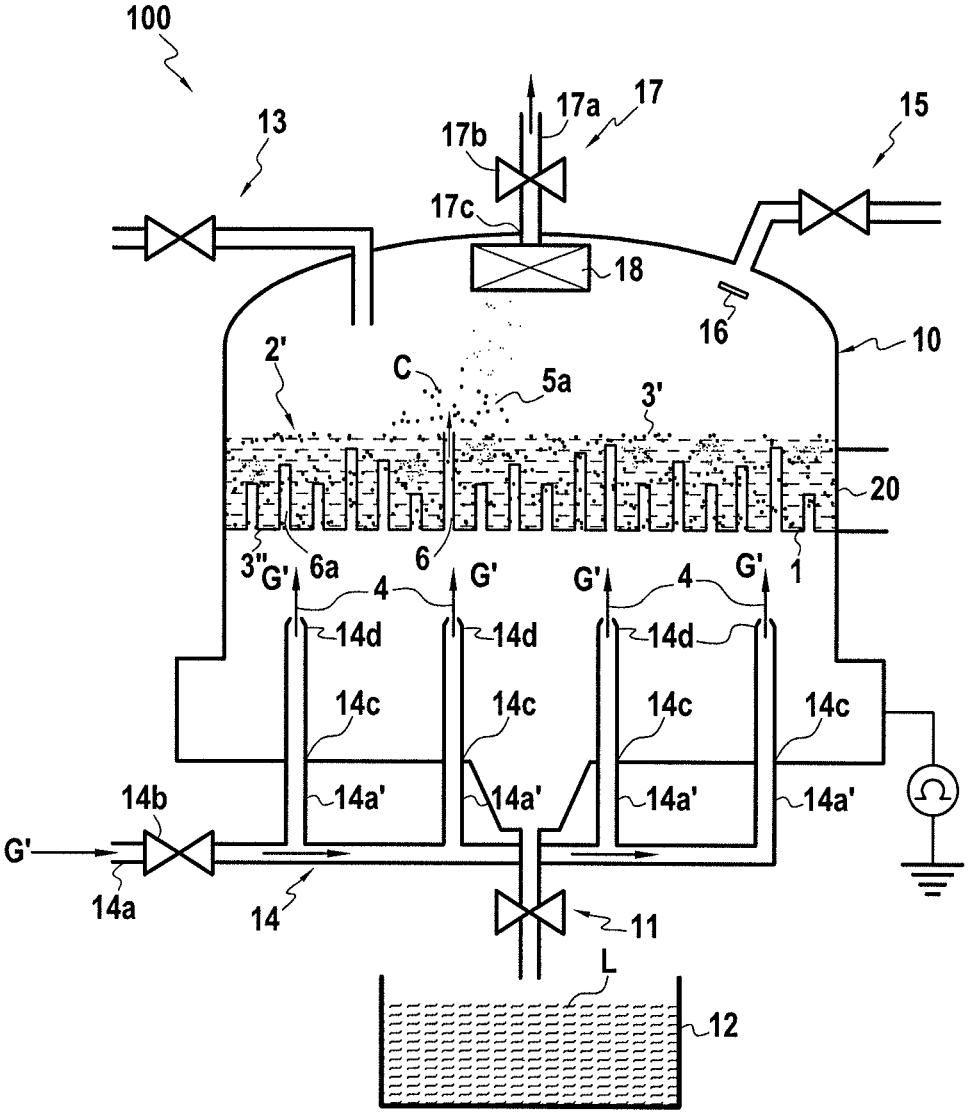
FIGS. 3A, 3B and 3C illustrate the progression of the disintegration of the dewatered cake until obtaining the fluidized bed (FIG. 3C).

In said FIG. 3A, "the attack" on the integrity of the dewatered cake 2' (direct attack by jets of gas, the gas being injected according to the first set of conditions), i.e. the appearance and the growth of channels 6*a* in the thickness of said dewatered cake 2', which growth of said channels 6*a* converts the latter into emerging channels 6 (or chimneys 6), has been represented diagrammatically. The eroded material which circulates in said channels 6*a* and 6 participates in the expansion of the erosion, very particularly at the upper surface 3' of the (disintegrating) dewatered cake 2', once it has exited from said channels 6. The charges thus extracted from said cake 2', which are more or less dry, are suspended above said cake 2'. They constitute there an expanding fluidized bed 5*a*.

Figure 3B:
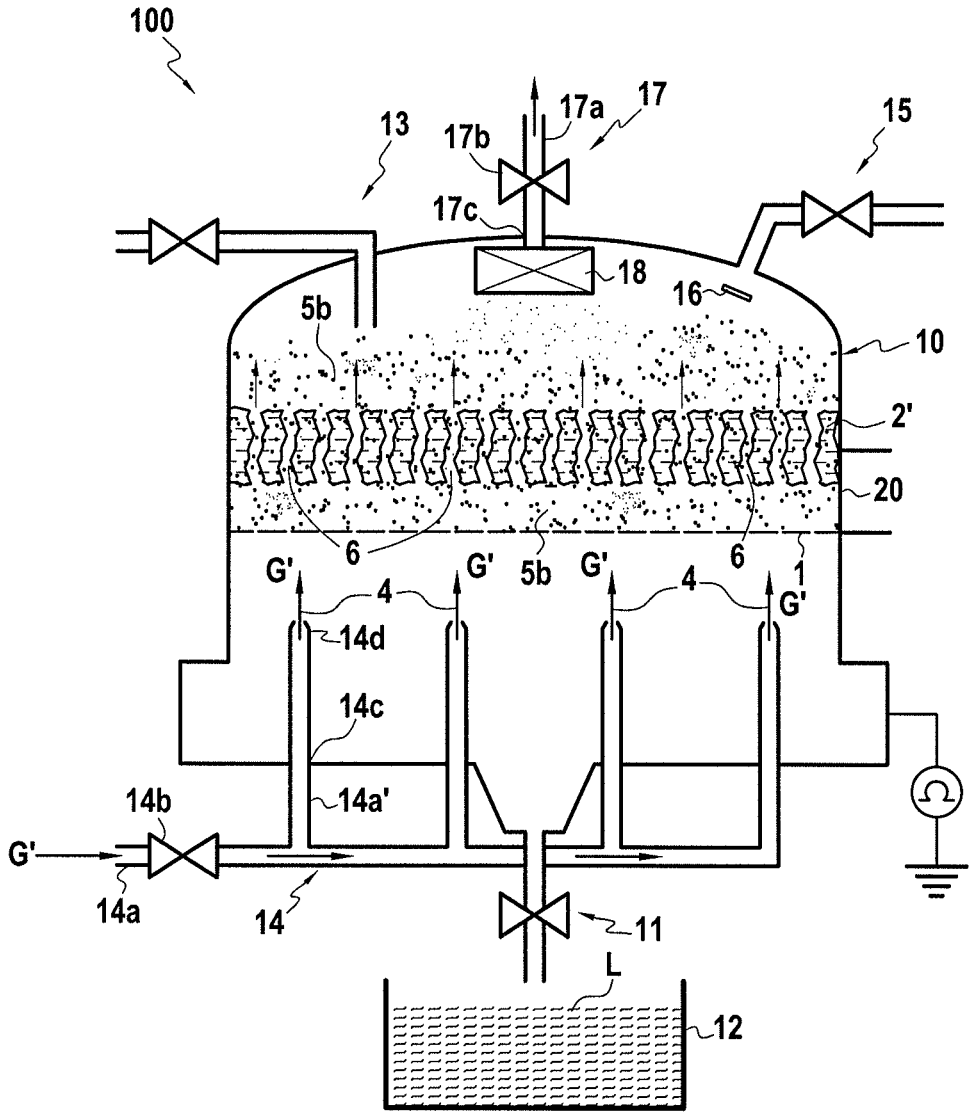

In said FIG. 3B, the continuation of "the attack" on the integrity of the dewatered cake 2' (already partially disintegrated) has been represented diagrammatically. This attack, under the action of more powerful jets 4 (under the direct impact of said jets 4), detaches, from the filter 1, the disintegrating dewatered cake 2', which is then traversed by (wider) channels 6. This leads to a fluidized bed 5*b* (still expanding) which tends to occupy all the free volume of the enclosure 10.

Figure 3C:
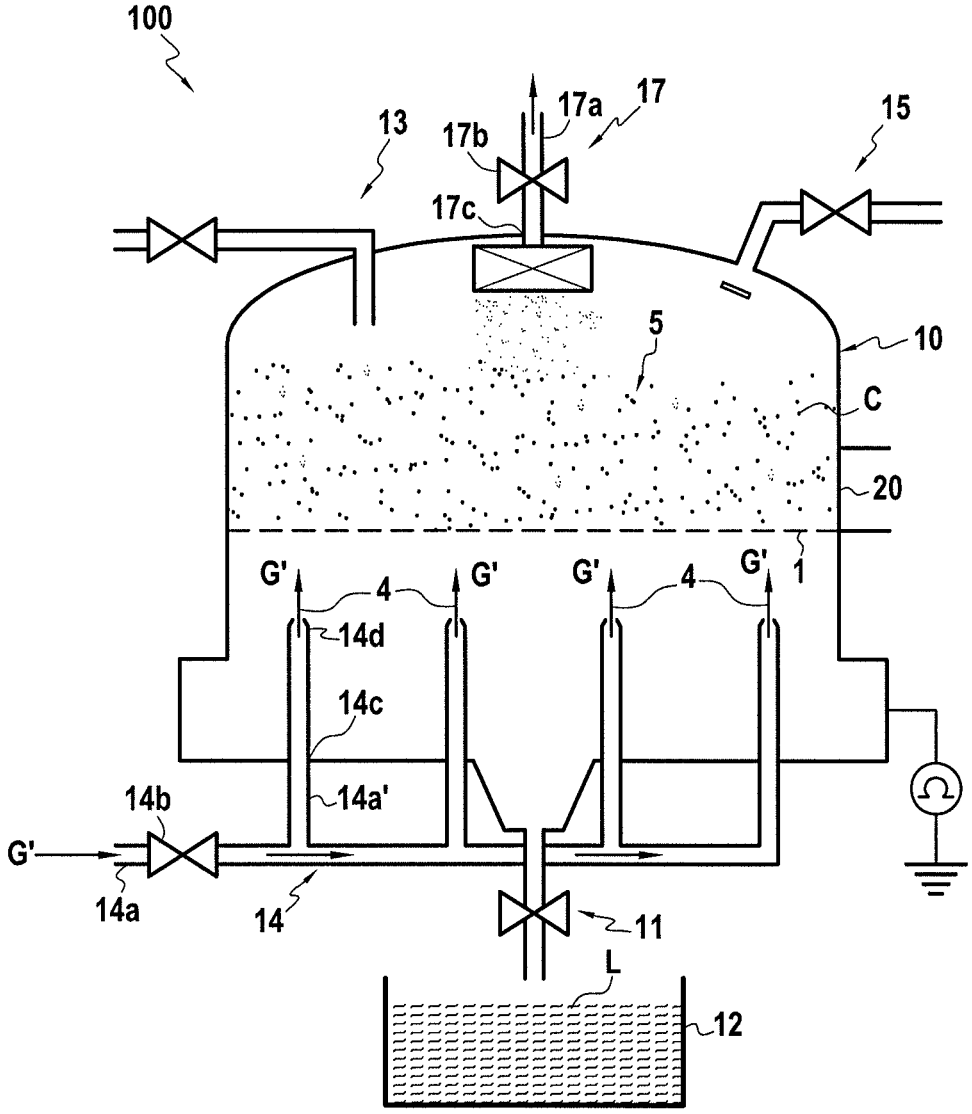

In FIG. 3C, the dewatered cake 2' has been completely disintegrated and the charge C, as a fluidized bed 5, occupies the entire free volume of the enclosure 10.

In said FIGS. 3A, 3B and 3C, it is understood that the valve 17*b* is opened for the discharge of a portion of the injected gas G' and moreover of the liquid L' (in the gaseous state and possibly in the form of droplets) still present in the dewatered cake 2' at the end of the pressurizing step (the valves 13*b*, 15*b* and 11*b* obviously being closed). The charges C having smaller sizes (<30 μm) are not discharged; they remain trapped in the particle filter 18.

A description has in particular been given above of the mechanical action of the gas G' insofar as it is easily displayed with regard to the physical state of the dewatered cake 2'. It has very obviously been understood that said gas G' also provides for the drying of the charge C, this drying being better and better as the disintegration of said dewatered cake 2' goes along, the residual liquid L' present in said dewatered cake 2' being entrained (in the gaseous state and possibly in the form of droplets).

Figure 4:
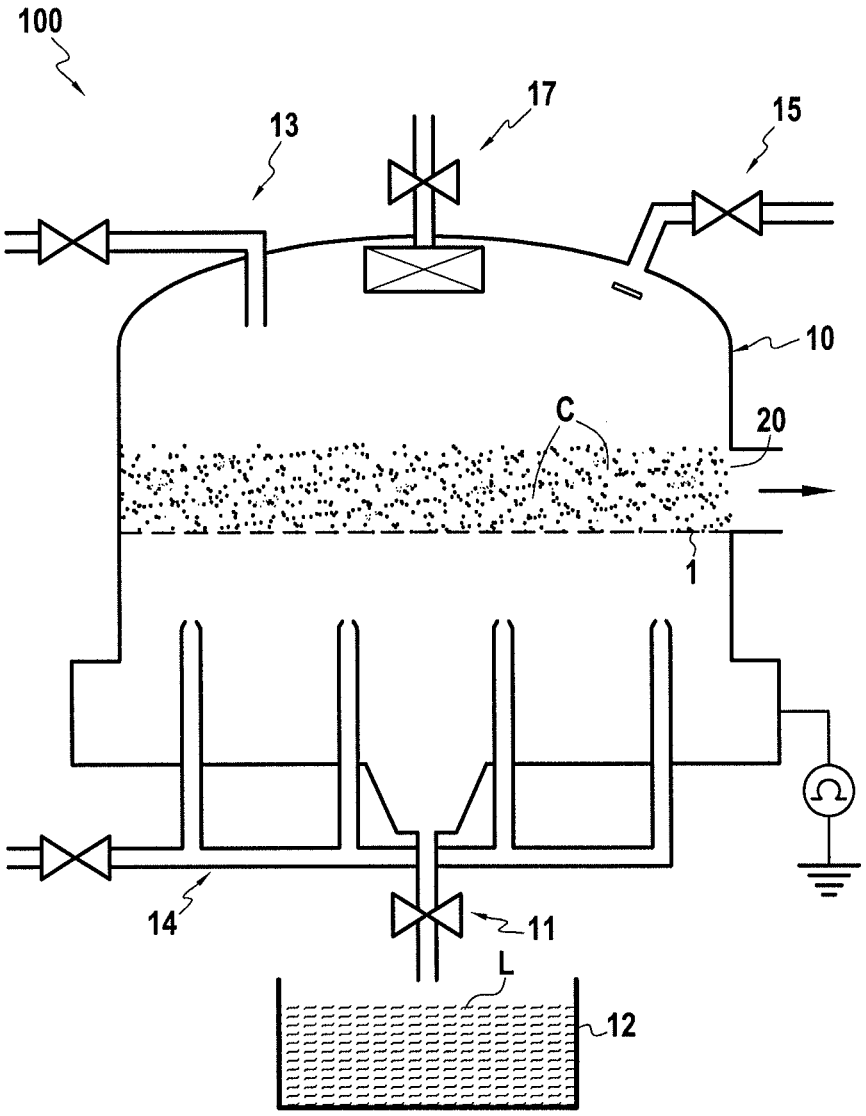
FIG. 4 illustrates the virtually final phase of the process (the dry charge is deposited on the filter, immediately before it is recovered).

On conclusion of the implementation of step c of the process, the feed of gas G' is stopped (the valve 14*b* is closed and the jets 4 are cancelled). The fluidized bed 5 disappears and the charge C, in dry and granular form, is deposited on the filter 1. It can be recovered there via the opening 20 of the enclosure 10. This opening 20 has obviously been provided at an appropriate height. The recovery of the dry charge C can be carried out via an airlock, a glove box, arranged on said opening 20. FIG. 4 shows the charge C on the filter 1 and the opened opening 20 with an arrow to symbolize the step of recovery of said charge C in dry and granular form.

EXAMPLE

The process of the invention has been carried out, in a device (enclosure of substantially cylindrical shape (H (height)=40 cm, D (diameter)=40 cm)) as represented diagrammatically in the appended figures, to recover, dry, an ONTA charge from a suspension including 10 kg of ONTA in water (75 liters).

The ONTA crystals of the suspension exhibited a monomodal particle size distribution with a median diameter ($D_{50}$) of 200 μm. The suspension concerned exhibited a water/ONTA ratio by weight of 7.5.

Step a (Filtration)

The filter, arranged in the bottom part of the volume of the enclosure, was a filter made of stainless steel which exhibited a porosity graded at 150 μm.

The suspension was introduced into the enclosure above the filter. Its passage through said filter generated, on the latter, a cake (h (height)=20 cm, D (diameter)=40 cm). This cake exhibited a water/ONTA ratio by weight of approximately 5. The liquid was discharged in the bottom part of the enclosure.

Step b (Dewatering)

The upper part of the enclosure was subsequently pressurized from $2\times10^5$ Pa absolute (2 bar absolute) to $3\times10^5$ Pa absolute (3 bar absolute) for the purposes of dewatering the cake.

The pressurizing gas (air) injected in the top part of the enclosure was dry gas (1% (by weight) of moisture).

The pressure was maintained for 1 h.

On conclusion of this pressurizing, the dewatered cake (h (height)<10 cm, D (diameter)=40 cm) was obtained in the enclosure, resting on the filter, which cake exhibited a water/ONTA ratio by weight of approximately 1.

During this pressurizing, dewatering liquid was discharged.

Step c (Obtaining a Fluidized Bed of Dry ONTA Grains)

Step c1 (Creation of Channels (Chimneys) in the Dewatered Cake)

Dry air (1% moisture) was then injected via the bottom of the enclosure (by 2 injectors) at a temperature of approximately 60° C. for 0.5 h. Said dry air thus (directly) impacted the face of the dewatered cake resting on the filter.

Said dry air was injected at a flow rate of 20 to 50 $Nm^3/h$ and at a pressure varying (+0.16 bar/min) along a pressure gradient from 5 bar to 7 bar (from $5\times10^5$ to $7\times10^5$ Pa).

The means provided in the top part of the chamber for the discharge of the drying gas (dry air charged with the liquid from the dewatered cake) were equipped with a particle filter.

Step c2 (Lift of the Dewatered Cake with Channels+Erosion at the Surface and in the Volume of the Cake=Fluidized Bed)

The same injection means were used to inject the same dry air (1% moisture) at the same temperature for a further 0.5 h, at a flow rate of 100 to 200 $Nm^3/h$ and along a pressure gradient from 5 bar to 7 bar (from $5\times10^5$ to $7\times10^5$ Pa).

The cake, on conclusion of this 0.5 h, had entirely disintegrated. The grains of the explosive charge were dry, under lift. They constituted, with the dry air injected, a fluidized bed.

Step d

Once the injection of air was stopped, the dry grains settled on the filter and were recovered there.

Approximately 9.5 kg of grains were recovered; the remainder of the 10 kg present in the initial suspension were lost in the filtration (smaller crystals) or were found trapped in the particle filter.

The water/ONTA ratio by weight of the dry charge recovered was 0.1%.

The invention claimed is:

1. A process for obtaining, from a suspension of an explosive charge in a liquid, said explosive charge in dry and granular form, comprising:

a) filtering, by passage through a static filter, said suspension, in order to obtain a cake, on said filter, including said explosive charge agglomerated by residual liquid;

b) dewatering said cake by placing it under gas pressure;

c) disintegrating the dewatered cake and obtaining a fluidized bed of the desired explosive charge, in dry and granular form, by the action, on said dewatered cake, of at least one gas jet, said at least one gas jet being injected, under said dewatered cake, in order to impact said dewatered cake, according to two successive sets of conditions:

at first, at pressure p and at flow rate f, in order to create, in the dewatered cake, channels emerging in the upper part of said dewatered cake and also a fluidized bed above said dewatered cake; then subsequently, at pressure p and at flow rate F, F>f, in order to put the dewatered cake, traversed by said channels, under lift and to complete its disintegration;

and said gas exhibiting a lower moisture content than that of the dewatered cake and a dew point greater than its injection temperature; and d) stopping said at least one gas jet and recovering said explosive charge in dry and granular form.

2. The process as claimed in claim 1, wherein the explosive charge is recovered in granular form and containing less than 1% by weight of liquid.

3. The process as claimed in claim 1, wherein said suspension exhibits a liquid/explosive charge ratio by weight of between 5 and 20.

4. The process as claimed in claim 1, wherein said cake exhibits a liquid/explosive charge ratio by weight of between 1 and 8.

5. The process as claimed in claim 1, wherein dewatering is carried out under a gas pressure between $2\times10^5$ and $3\times10^5$ Pa absolute (2 and 3 bar absolute).

6. The process as claimed in claim 1, wherein, on conclusion of step b), said dewatered cake exhibits a thickness of a maximum of 10 cm.

7. The process as claimed in claim 1, wherein said dewatered cake exhibits a liquid/explosive charge ratio by weight of between 0.5 and 2.

8. The process as claimed in claim 1, wherein said pressure p and said flow rates f and F are increasing.

9. The process as claimed in claim 1, wherein said gas is injected in the form of at least two jets.

10. The process as claimed in claim 1, wherein said injected gas exhibits a moisture content of less than 2% by weight and a temperature of between 20 and 70° C.

11. The process as claimed in claim 1, wherein said explosive charge is chosen from 3-nitro-1,2,4-triazol-5-one (ONTA), ammonium dinitramide (ADN), 2,4,6-triamino-1,3,5-trinitrobenzene (TATB) and trinitrotoluene (TNT) charges.

12. The process as claimed in claim 1, wherein said liquid is chosen from water, acidic aqueous solutions and organic solvents.

13. The process as claimed in claim 1, wherein the explosive charge is recovered in granular form and containing less than 0.1% by weight of liquid.

14. The process as claimed in claim 1, wherein said injected gas exhibits a moisture content of less than 2% by weight and a temperature of between 50 and 70° C.

15. The process as claimed in claim 1, wherein said liquid is chosen from aliphatic hydrocarbons, halogenated aliphatic hydrocarbons, aromatic hydrocarbons and nonflammable hydrofluoroethers.

16. The process of claim 1, wherein in the filtering step, a substantially cylindrical enclosure comprises, in its volume, in its bottom part, a filter capable of filtering a suspension and retaining a solid phase of the suspension;

wherein the suspension is fed to the enclosure with a feeder, the feeder being arranged above the filter, and a liquid is discharged from the enclosure by a liquid discharger, the liquid discharger being arranged below the filter;

wherein the enclosure is pressurized to create the pressure p with a pressurizer, the pressurizer being arranged above said filter;

wherein the at least one gas jet is injected with a gas-injector, the gas-injector being arranged below the filter and being capable of delivering the gas in the form of at least one upward jet intended to impact the face of the retained solid phase resting on the filter; and wherein the gas is discharged from the enclosure with a gas discharger, the gas discharger being arranged above the filter.

17. The process of claim 16, wherein the pressurizer comprises a deflector.

18. The process of claim 16, wherein the gas-discharger comprises a particle filter.

19. The process of claim 16, wherein the cylindrical enclosure is connected, in its entirety, to earth.

* * * * *